US005578108A

United States Patent [19]

Yamaguchi et al.

[11] Patent Number: 5,578,108

[45] Date of Patent: Nov. 26, 1996

[54] ULTRAFINE PARTICLES OF AMORPHOUS METAL AND METHOD FOR PRODUCTION THEREOF

[75] Inventors: Tadashi Yamaguchi, Sendai; Katsutoshi Nosaki, Wako; Akihisa Inoue, 11-806, Kawauchijutaku, Mubanchi, Kawauchi, Aoba-ku; Tsuyoshi Masumoto, 3-8-22, Kamisugi, Aoba-ku, both of Sendai-shi, Miyagi-ken, all of Japan

[73] Assignees: YKK Corporation, Tokyo; Tsuyoshi Masumoto; Akihisa Inoue, both of Miyagi-ken; Honda Giken Kogyo Kabushiki Kaisha, Tokyo, all of Japan

[21] Appl. No.: 313,827

[22] Filed: Sep. 28, 1994

[30] Foreign Application Priority Data

Sep. 29, 1993 [JP] Japan ..... 5-264105

[51] Int. Cl.[6] ..... B22F 9/14

[52] U.S. Cl. ..... 75/336; 75/346; 75/10.19; 75/10.22

[58] Field of Search ..... 75/336, 346, 10.19, 75/10.22

[56] References Cited

U.S. PATENT DOCUMENTS 3,279,912 10/1966 Death et al. ..... 75/10.19
4,812,166 3/1989 Saiki et al. ..... 75/346
5,460,701 10/1995 Parker et al. ..... 75/10.19

FOREIGN PATENT DOCUMENTS 2-38505 2/1990 Japan .
2-232309 9/1990 Japan ..... 75/346
2-294417 12/1990 Japan .

*Primary Examiner*—George Wyszomierski
*Attorney, Agent, or Firm*—Finnegan, Henderson, Farabow, Garrett & Dunner, L.L.P.

[57] ABSTRACT

Ultrafine amorphous metal particles which combine the properties of ultrafine particles with those of an amorphous alloy and a method for the production thereof are disclosed. The ultrafine amorphous metal particles are produced by a method which comprises discharging a plasma arc against a raw metal capable of forming a carbide in a reaction gas using an inert gas as a main component thereof and containing a hydrocarbon gas, and allowing the metal which has been consequently vaporized to contact the reaction gas which has been consequently converted into a plasma, thereby inducing formation of a solid solution of carbon atoms in the vaporized metal and quenching the solid solution in the reaction gas to confer an amorphous structure thereon. As the raw metal, at least one metal selected from the group consisting of Fe, Mo, Nb, Ta, Ti, Zr, Al, Si, and Cr is preferably used. By this method are obtained ultrafine amorphous metal particles which comprise the metal mentioned above, possess at least 50% by volume of an amorphous phase, and have particle diameters of not more than 500 nm.

7 Claims, 4 Drawing Sheets

ULTRAFINE PARTICLES OF AMORPHOUS METAL AND METHOD FOR PRODUCTION THEREOF

BACKGROUND OF THE INVENTION

1. Field of the Invention

This invention relates to ultrafine particles of amorphous metal and a method for the production thereof.

2. Description of the Prior Art

Heretofore, various methods have been introduced for the production of ultrafine particles of metals. For example, Japanese Patent Application, KOKAI (Early Publication) No. 2-294,417 discloses a method for producing an ultrafine copper powder by decomposing copper hydride and Japanese Patent Application, KOKAI No. 2-38,505 discloses a method for producing an ultrafine metal powder by subjecting a metal powder to repeated oxidation and pulverization thereby forming ultrafine metal oxide particles and reducing the particles in an atmosphere of high-temperature plasma containing a reducing gas and, at the same time, conferring a spherical shape on the particles. These ultrafine particles of metals have been used as high-quality magnetic materials for magnetic tapes, as sintering additives, and the like, depending on the characteristics inherent in their raw materials. The ultrafine metal particles which are obtained by the methods cited above, however, possess a crystalline structure.

Incidentally, amorphous alloys are inherently suitable as high permeability materials because they have their component atoms substantially randomly adjoin their neighbors and are devoid of magnetic anisotropy due to symmetry. Further, the amorphous materials are at an advantage in exhibiting high mechanical strength, offering high electrical resistance, and manifesting excellent resistance to corrosion in addition to excelling in magnetic characteristics.

Generally such methods as rapid solidification, vacuum deposition, and sputtering are adopted for the production of amorphous materials. These methods, however, are specifically intended for the production of materials which are thin ribbons, wires, and films in shape.

SUMMARY OF THE INVENTION

Ultrafine particles have a large specific surface area, strong activity, and very high reactivity. In contrast thereto, the amorphous alloys manifest specific properties including the high mechanical strength, high electrical resistance, excellent resistance to corrosion, and soft magnetic properties, as mentioned above.

The fundamental object of the present invention is therefore to provide ultrafine amorphous metal particles which combine the properties of ultrafine particles with those of amorphous alloys.

Another object of the present invention is to provide a method capable of infallibly and easily producing the ultrafine amorphous metal particles mentioned above and consequently realize inexpensive provision of industrial quality materials combining high strength, high resistance to corrosion, high activity, and soft magnetic properties.

To accomplish the objects described above, the present invention provides a method for the production of ultrafine amorphous metal particles, which comprises discharging a plasma arc against a raw metal in a reaction gas using an inert gas as a main component and containing a hydrocarbon gas, and allowing the metal which has been vaporized to contact the reaction gas which has been converted into a plasma, thereby inducing the formation of a solid solution of carbon atoms in the vaporized metal and, at the same time, quenching the solid solution in the reaction gas to confer an amorphous structure thereon. As the raw material, at least one metal selected from the group consisting of Fe, Mo, Nb, Ta, Ti, Zr, Al, Si, and Cr is preferably used. It should be noted that the metallic elements cited above are invariably capable of forming carbides.

In accordance with the method described above, ultrafine amorphous metal particles comprising at least one metal selected from the group consisting of Fe, Mo, Nb, Ta, Ti, Zr, Al, Si, and Cr, possessing at least 50% by volume of an amorphous phase, and having particle diameters of not more than 500 nm are obtained.

BRIEF DESCRIPTION OF THE DRAWINGS

The other objects, features, and advantages of the present invention will become apparent from the following description taken together with the drawings, in which.

DETAILED DESCRIPTION OF THE INVENTION

Figure 1:
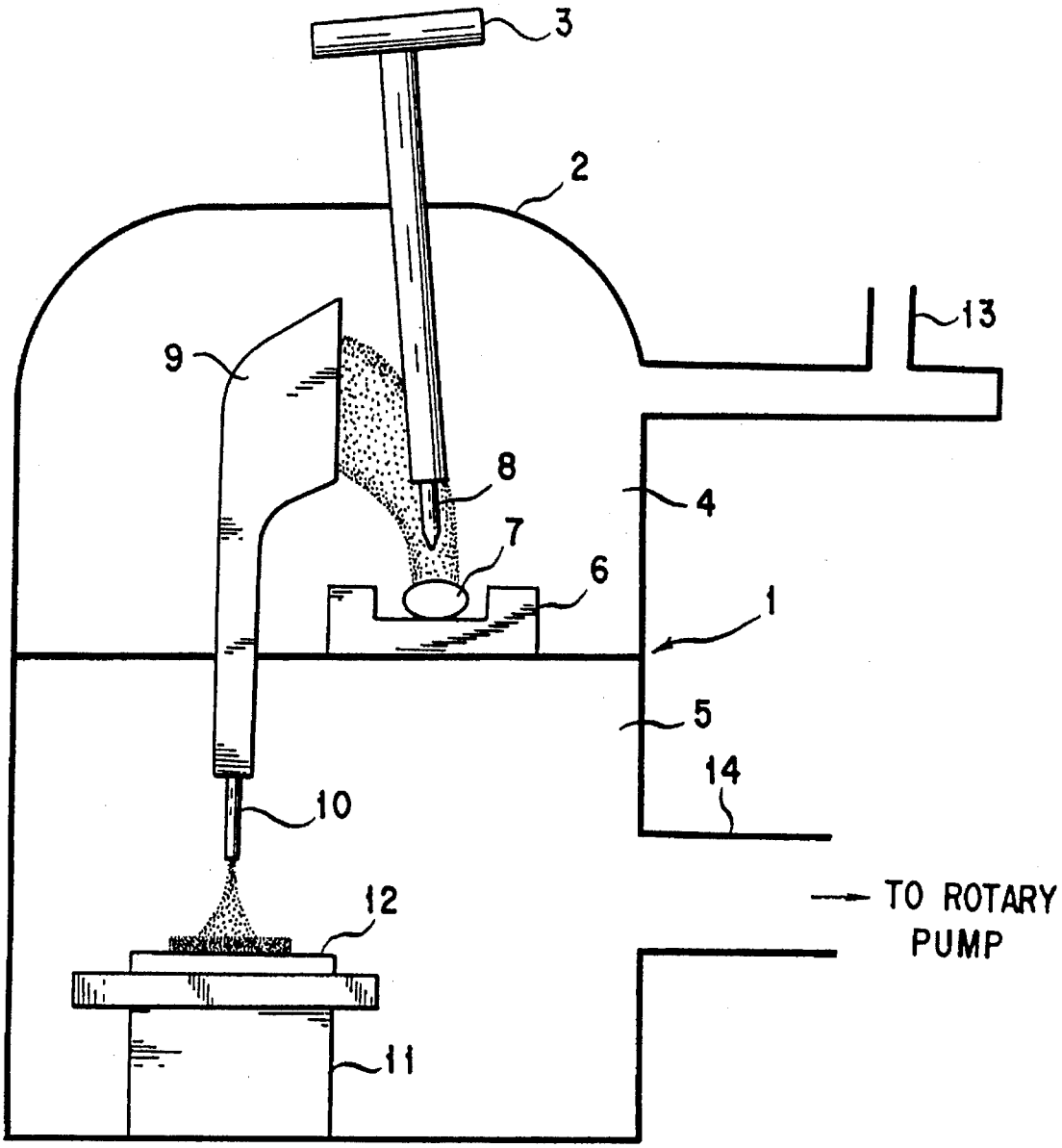
FIG. 1 is a schematic structural diagram of one embodiment of an apparatus for producing ultrafine amorphous metal particles by the arc melting in accordance with the method of the present invention.

The method of the present invention for the production of ultrafine amorphous metal particles is characterized by using a metal capable of forming a carbide as a raw material, thermally melting the raw metal by discharging a plasma arc against the metal in a reaction gas using an inert gas as a main component thereof and containing a hydrocarbon gas, and enabling the metal which has been vaporized to undergo contact reaction with the reaction gas which has been converted into a plasma.

When the metal which has been vaporized in consequence of the fusion with the plasma is allowed to contact the reaction gas which has been converted into the plasma, they form a solid solution of carbon atoms in the vaporized metal and, at the same time, the solid solution is quenched with the reaction gas and furnished with an amorphous structure. In this while, the metallic gas arising from the vaporization due to the discharge of the plasma arc and the hydrocarbon gas contained in the reaction gas undergo ionization within the plasma of a high temperature and readily give rise to a metal-carbon linkage and this linkage lends itself to the formation of the amorphous structure. The ultrafine particles thus produced have been investigated by the methods of X-ray diffraction and the energy dispersive X-ray spectroscopy (EDX) to determine their structure and composition. The results indicate that the ultrafine particles produced by melting pure iron by the discharge of a plasma arc in an atmosphere having a methane partial pressure of less than 1

Torr in a total gas pressure of 300 Torr display an X-ray diffraction pattern comprising a peak of α -Fe and a broad peak, whereas the ultrafine amorphous iron particles having particle diameters of not more than about 500 nm and displaying an X-ray diffraction pattern solely comprising a broad peak are obtained under the same conditions except for an increase of the methane partial pressure to not less than 1 Torr.

The reaction gas to be used herein uses such an inert gas as argon, helium, or krypton, preferably argon, as a main component thereof and contains such a hydrocarbon gas as methane or ethane, preferably methane gas. The total pressure of the reaction gas is desired to be less than 760 Torr and the partial pressure of the hydrocarbon gas contained in the reaction gas to be in the range of from 1 to 50 Torr. If the partial pressure of the hydrocarbon gas in the reaction gas is less than 1 Torr, the ultrafine particles to be produced will be deficient in metal-carbon linkage and will acquire an amorphous structure only with difficulty. Conversely, if this partial pressure exceeds 50 Torr, the produced ultrafine particles will be at a disadvantage in entraining crystals of a metal carbide. The more desirable partial pressure of the hydrocarbon gas, though variable with the kind of metal or alloy, is in the range of from 1 to 30 Torr in the case of such elemental metals as Fe, Mo, Nb, Ta, and Ti, in the range of from 1 to 20 Torr in the case of such elemental metals as Zr and Al, and in the range of from 1 to 10 Torr in the case of Fe alloys containing Mo, Si, and/or Cr.

When the raw material is an alloy of iron with another metallic element such as, for example, Mo or Cr, it is desired to contain Mo or Cr in a proportion of not more than 50 atomic %. The reason for this upper limit 50 atomic % is that the produced ultrafine particles entrain crystals of the carbide of the added element (Mo, Cr) when the proportion of the added element to the Fe alloy exceeds 50 atomic %. For the same reason, the Fe alloy containing Si is desired to have an Si content of not more than 25 atomic %. When the ultrafine particles produced using a matrix alloy of 50 at% Fe-50 at% Mo and a methane partial pressure of about 5 Torr are observed through a transmission electron microscope (TEM), they are found to be ultrafine composite particles of the structure having particles of diameters from several nm to some tens of nm included in an amorphous particle showing no contrast and having a diameter of some hundreds of nm. The formation of these ultrafine composite particles may be logically explained by a postulate that the hydrogen dissolved into a molten mass of the matrix alloy forcibly vaporizes the molten alloy into ultrafine particles and the ultrafine particles are then composited when they are allowed to cool.

The present invention easily produces the ultrafine amorphous metal particles without having to resort to the conventional method which solely resides in quenching. Since the ultrafine amorphous metal particles combine the properties inherent in an amorphous alloy with the properties inherent in ultrafine particles as described above, they acquire such properties as high strength, high resistance to corrosion, high activity, and soft magnetic properties, depending on the particular kind of metal or alloy and find extensive utility as raw materials for various industrial products.

Now, the present invention will be described more specifically with reference to working examples to be cited hereinbelow.

FIG. 1 is a schematic structural diagram illustrating one embodiment of an apparatus 1 to be used for the production of ultrafine amorphous metal particles by the arc melting in accordance with the method of the present invention, as adopted in the following working examples. In FIG. 1, the reference numeral 2 stands for a vacuum vessel and 3 for an arc electric sorce. The vacuum vessel 2 is divided into two compartments; an upper chamber 4 and a lower chamber 5. A raw material 7 disposed in a hearth 6 inside the upper chamber 4 is melted by an electric arc and allowed to produce ultrafine particles. The ultrafine particles thus produced are collected by the stream of Gas in a collection umbrella 9, forwarded through a nozzle 10, and deposited on a substrate 12 disposed on the upper side of a substrate stage part 11. The reference numerals 13 and 14 respectively stand for a gas inlet and a gas outlet.

Next, the procedure for producing ultrafine amorphous metal particles by the use of an apparatus 1 illustrated in FIG. 1 will be described.

A varying metal or alloy indicated in Table was set in place on the hearth 6 in the apparatus 1 shown in FIG. 1. A valve (not shown) of the gas inlet 13 was closed and upper and lower chambers 4 and 5 were evacuated via the gas outlet 14 to adjust the inner pressure of the upper and lower chambers at a level in the approximate range of from $1\times10^{-3}$ to $1\times10^{-4}$ Torr. Then, a mixture containing argon gas and methane gas at varying concentrations indicated in Table was introduced via the gas inlet 13 into the upper chamber 4 and a valve (not shown) on the gas outlet 14 side was slightly opened to resume the evacuation of the lower chamber 5. At this time, the amount of the mixed gas introduced via the gas inlet 13 and the amount of the gas discharged via the gas outlet 14 were adjusted so that the inner pressure of the upper chamber 4 might be kept at 300 Torr. The methane gas concentration in the mixed gas was adjusted by the partial pressure of the methane gas to be introduced. While the pressure of the mixed gas in the upper chamber 4 was kept at 300 Torr, an arc electrode 8 was set discharging an arc to thermally melt the metal or alloy at an arc current of 200 A. A nozzle 10 spouted ultrafine metal or alloy particles to produce a deposit on a substrate 12 made of glass plate.

The deposit was extracted from the chamber and subjected to the X-ray diffraction and to the electron diffraction in a TEM to determine whether it possessed an amorphous structure or a crystalline structure. The sample was rated as an amorphous product when the X-ray diffraction and the electron diffraction both produced a broad diffraction peak or a halo pattern exclusively. The results of the experiment are shown in the table.

Table

| Raw material metal or alloy | $CH_4$ partial pressure (Torr) in mixture ($Ar + CH_4$) | Structure |
|---|---|---|
| Fe | 30 | Amorphous |
| Fe | 20 | Amorphous |
| Fe | 5 | Amorphous |
| Mo | 20 | Amorphous |
| Nb | 20 | Amorphous |
| Ta | 20 | Amorphous |
| Fe-25 at% Mo | 5 | Amorphous |
| Fe-10 at% Mo | 5 | Amorphous |
| Fe-48 at% Mo | 5 | Amorphous |
| Fe-10 at% Si | 5 | Amorphous |
| Fe-20 at% Si | 5 | Amorphous |
| Fe-15 at% Cr | 5 | Amorphous |
| Fe-30 at% Cr | 5 | Amorphous |

Table-continued

| Raw material metal or alloy | $CH_4$ partial pressure (Torr) in mixture ($Ar + CH_4$) | Structure |
|---|---|---|
| Fe-45 at% Cr | 5 | Amorphous |
| Ti | 15 | Amorphous |
| Zr | 10 | Amorphous |
| Al | 10 | Amorphous |
| Fe | 50 | Amorphous + crystal (Amo ≧ 50%) |
| Mo | 50 | Amorphous + crystal (Amo ≧ 50%) |

Figure 2:
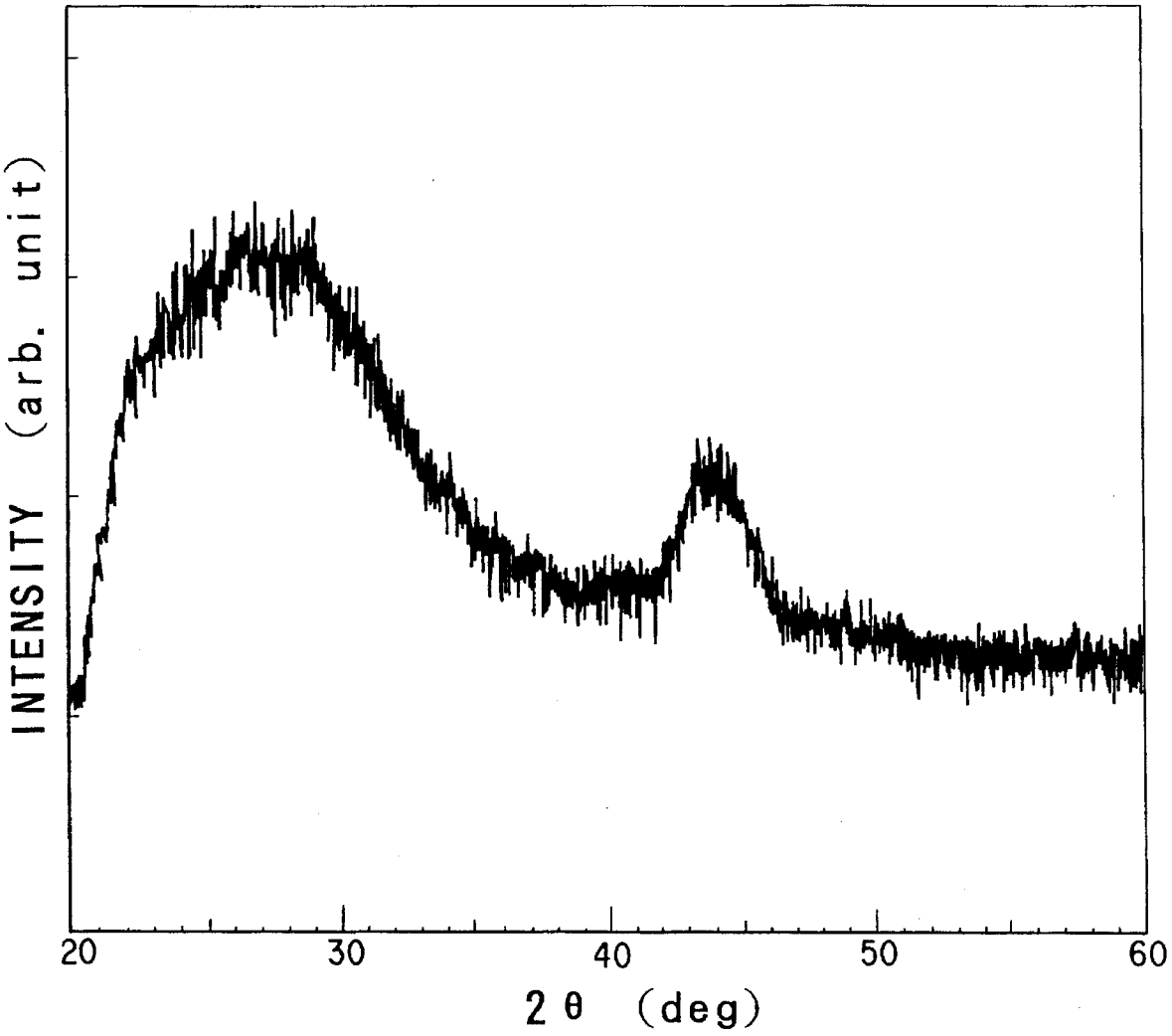
FIG. 2 is a diagram of an X-ray diffraction pattern obtained of one of the ultrafine amorphous particles produced solely with iron as a raw material under the conditions of an argon gas partial pressure of 290 Torr and a methane gas partial pressure of 10 Torr (total pressure 300 Torr)
Figure 3:
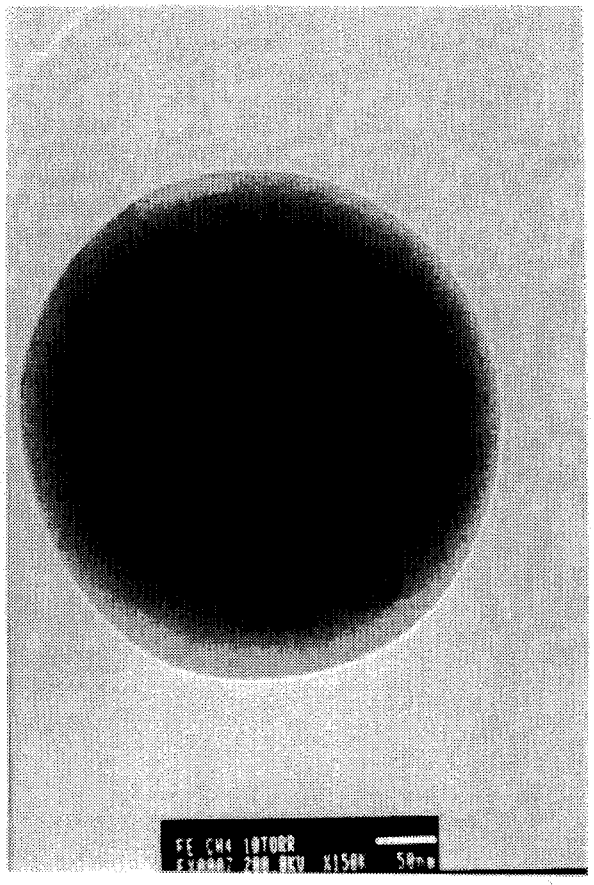
FIG. 3 is a transmission electron micrograph obtained of the same ultrafine particle as in FIG. 2.
Figure 4:
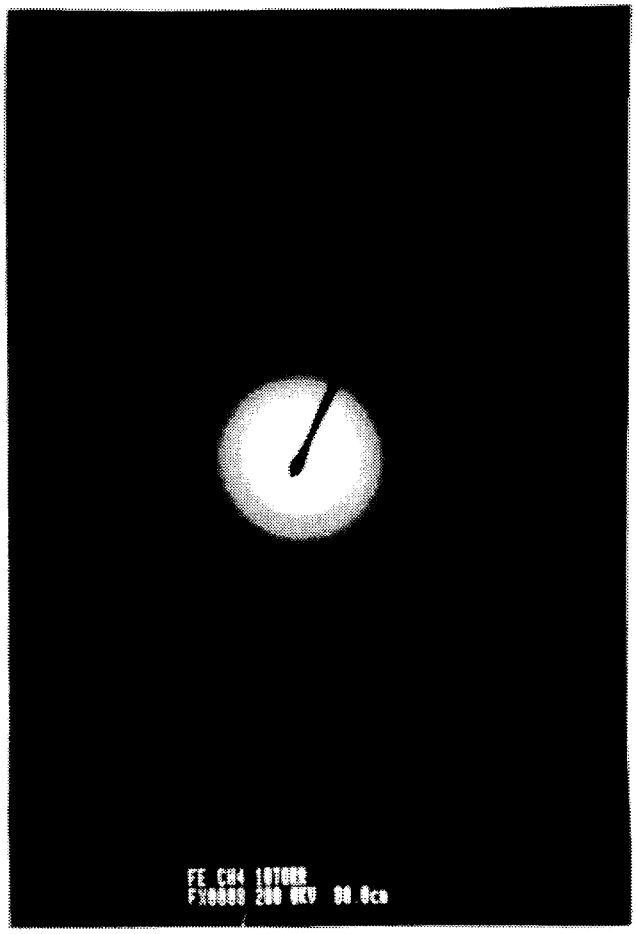
FIG. 4 is a transmission electron micrograph showing an electron diffraction image of the same ultrafine particle as in FIG. 2.

An X-ray diffraction pattern of an ultrafine particle produced using iron alone as a raw material under the conditions of an argon gas partial pressure of 290 Torr and a methane gas partial pressure of 10 Torr (total pressure 300 Torr) is shown in FIG. 2, a transmission electron micrograph of the same ultrafine particle in FIG. 3, and a transmission electron micrograph showing an electron diffraction image in FIG. 4. It is clearly noted from FIGS. 2 to 4 that the product was ultrafine amorphous iron particles. It is remarked from the results given in the table that the method of the present invention produces ultrafine amorphous metal particles or ultrafine amorphous metal particles containing at least 50% by volume of an amorphous phase.

As described in detail above, the present invention permits easy and inexpensive production of ultrafine metal particles having an amorphous structure. The ultrafine amorphous metal particles thus obtained combine such properties of amorphous alloy as abounding in mechanical strength, offering high electrical resistance, excelling in resistance to corrosion, and manifesting soft magnetic properties with such properties of ultrafine particles as a large specific surface area, strong activity, and very high reactivity. Thus, they acquire high strength, good resistance to corrosion, high activity, and soft magnetic properties, depending on the kind of metal. or the composition of alloy and, therefore, find extensive utility as raw materials for various industrial products.

While certain specific working examples have been disclosed herein, the invention may be embodied in other specific forms without departing from the spirit or essential characteristics thereof. The described examples are therefore to be considered in all respects as illustrative and not restrictive, the scope of the invention being indicated by the appended claims rather than by foregoing description and all changes which come within the meaning and range of equivalency of the claims are, therefore, intended to be embraced therein.

What is claimed is:

1. A method for production of ultrafine amorphous metal particles, comprising the steps of:

discharging a plasma arc against a raw metal, capable of forming a carbide, in a reaction gas having an inert gas as a main component thereof and containing a hydrocarbon gas, and allowing the metal, which has been vaporized, to contact said reaction gas, which has been converted into a plasma, thereby inducing formation of a solid solution of carbon atoms in said vaporized metal; and quenching said solid solution in said reaction gas to form an amorphous structure;

wherein said raw metal is at least one metal selected from the group consisting of Fe, Mo, Nb, Ta, Ti, Zr, Al, Si, and Cr, and wherein a total pressure of said reaction gas is less than 760 torr and a partial pressure of said hydrocarbon gas contained in said reaction gas is in the range of from 1 to 50 torr.

2. A method according to claim 1, wherein said raw metal comprises Fe containing not more than 50 atomic % of Mo or Cr.

3. A method according to claim 1, wherein said raw metal comprises Fe containing not more than 25 atomic % of Si.

4. A method according to claim 1, wherein said hydrocarbon gas contained in said reaction gas is methane gas.

5. A method according to claim 1, wherein said raw metal is Fe, Mo, Nb, Ta, or Ti and a partial pressure of said hydrocarbon gas contained in said reaction gas is in the range of from 1 to 30 Torr.

6. A method according to claim 1, wherein said raw metal is Zr or Al and a partial pressure of said hydrocarbon gas contained in said reaction gas is in the range of from 1 to 20 Torr.

7. A method according to claim 1, wherein said raw metal is a Fe alloy containing at least one of Mo, Si, and Cr and a partial pressure of said hydrocarbon gas contained in said reaction gas is in the range of from 1 to 10 Torr.

* * * * *